United States Patent [19]

Rowe et al.

[11] Patent Number: 4,484,623

[45] Date of Patent: Nov. 27, 1984

[54] DUAL FLOW CONDENSER WITH THROUGH CONNECTIONS

[75] Inventors: David W. Rowe, Springfield; William R. Waynick, Walnut Grove, both of Mo.

[73] Assignee: Paul Mueller Company, Springfield, Mo.

[21] Appl. No.: 482,968

[22] Filed: Apr. 8, 1983

[51] Int. Cl.[3] ..... F28F 9/22; F28F 3/14; F25B 27/02

[52] U.S. Cl. ..... 165/164; 165/170

[58] Field of Search ..... 165/164, 170

[56] References Cited

U.S. PATENT DOCUMENTS 4,111,659 9/1978 Bowley ..... 165/170 X 4,305,456 12/1981 Muell ..... 165/170 X

*Primary Examiner*—Allen M. Ostrager

*Attorney, Agent, or Firm*—Rogers, Eilers, Howell Renner, Moore and Haferkamp

[57] ABSTRACT

A coiled heat exchanger utilizing a sandwich plate type construction with a plurality of spot welds equally spaced throughout, the plate being inflated to expand the passageways therebetween, has fluid tight connections feeding through the outside of the coil for accessing both passageways adjacent and opposite the center divider plate. One or more arcuate slots are punched in the center divider plate and surround a spot weld, with a larger hole punched in the adjacent outer plate and a tube welded against the divider plate to seal the arcuate slot and form a fluid connection between the passageway opposite the divider plate and the outside of the coil.

15 Claims, 8 Drawing Figures

DUAL FLOW CONDENSER WITH THROUGH CONNECTIONS

BACKGROUND AND SUMMARY

Heat exchangers constructed from sandwiching together three stainless steel plates, spot welding in a regular pattern across the face of the plates, and inflating the plates to expand the passageways between the plates is well known in the art. An example of a condenser unit utilizing an inflated plate heat exchanger is shown in U.S. Pat. No. 4,305,456, owned by the assignee of the present invention. In the condenser unit disclosed in that patent, refrigerant flows through the heat exchanger, and the heat exchanger is immersed in a container of water with a counter flow circulation being set up in the condenser unit to optimize its performance. In the heat exchanger unit disclosed in that patent, a single sheet is folded over to create a horizontal passageway along the upper portion of the sheet which minimizes seams and welds, and also provides a smooth upper surface which minimizes the tendency for any corrosion to occur from impurities collecting at the top of the heat exchanger. As a single sheet is used, a single passageway is formed and only refrigerant flows through the heat exchanger unit. In other applications, a multiple plate construction has been utilized to form separate passageways within the same sheet type exchanger. In these devices, three sheets are utilized with the center sheet or divider plate being of a thicker gauge than the outer sheets such that when inflated, the outer sheets expand away from or "pillow" to increase the size of the passageway and enhance the performance of the heat exchanger. In these applications, the multiple sheet has generally been inflated and formed in a straight orientation, and separate connections provided on opposite sides of the heat exchanger to access the passageways on opposite sides of the central divider plate. With this construction, refrigerant or the like could pass through one passageway while water or any other fluid could flow through the other passageway and the heat exchange take place across the central divider plate.

It is desirable to coil these heat exchange units to simplify its mounting, increase its structural strength, and minimize the space required to mount it on a base plate or the like. However, when coiled and enclosed, access to the passageway along the interior of the coil, and opposite the divider plate, is a problem. Often times, these units are subject to vibration and not just any feed through connection can be utilized as it creates a weak point in the construction of the heat exchanger which can be subject to early failure. Furthermore, the plurality of spot welds and the inflation of the heat exchanger create a pillowed type surface which is very difficult to seal against and does not provide any smooth flat surface for connection.

To solve these and other problems, a flow through connection has been developed by the inventors herein which does not interfere with the integrity of the sandwich plate construction, or the plurality of spot welds, and provides a firm connection to the passageway on the interior of the coil, opposite the divider plate. This connection essentially comprises punching or cutting a hole in the outside plate which is centered over a spot weld, the outside plate not being welded at that specific location. Then, one or two arcuate slots are punched or cut in the center divider plate and around the spot weld.

The arcuate slots generally surround the spot weld as if the spot weld were at the center of a circle, and the slots partially form an annular ring therearound. The slots are contained within the envelope of the outer hole so that a tube may be placed directly through the outer hole and on to the center divider plate and welded in position to create a fluid tight seal. The outer plate is itself hammered down against the center divider plate and welded around the hole to seal the outside passageway. Thus there is formed a fluid type connection which feeds through one or two arcuate slots cut or punched in the center divider plate to the interior passageway of the coiled, sandwich tupe heat exchanger without interfering with the symetrical construction of the plate including pillowing around a plurality of spot welds.

The invention may be more fully appreciated by referring to the drawings and description of the preferred embodiment which follows.

DETAILED DESCRIPTION OF THE PREFERRED EMBODIMENT

Figure 2:
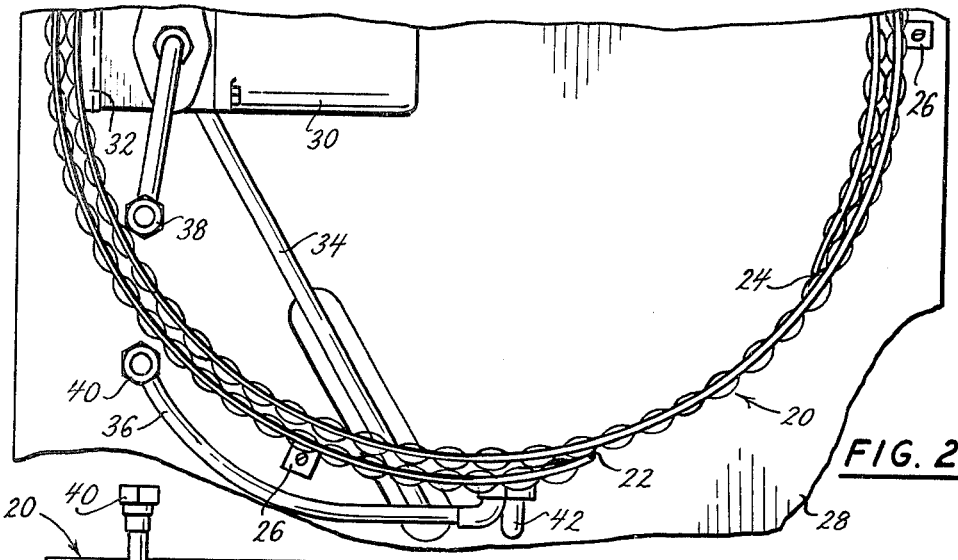
FIG. 2 is a partial top view further detailing the pipe connections.
Figure 1:
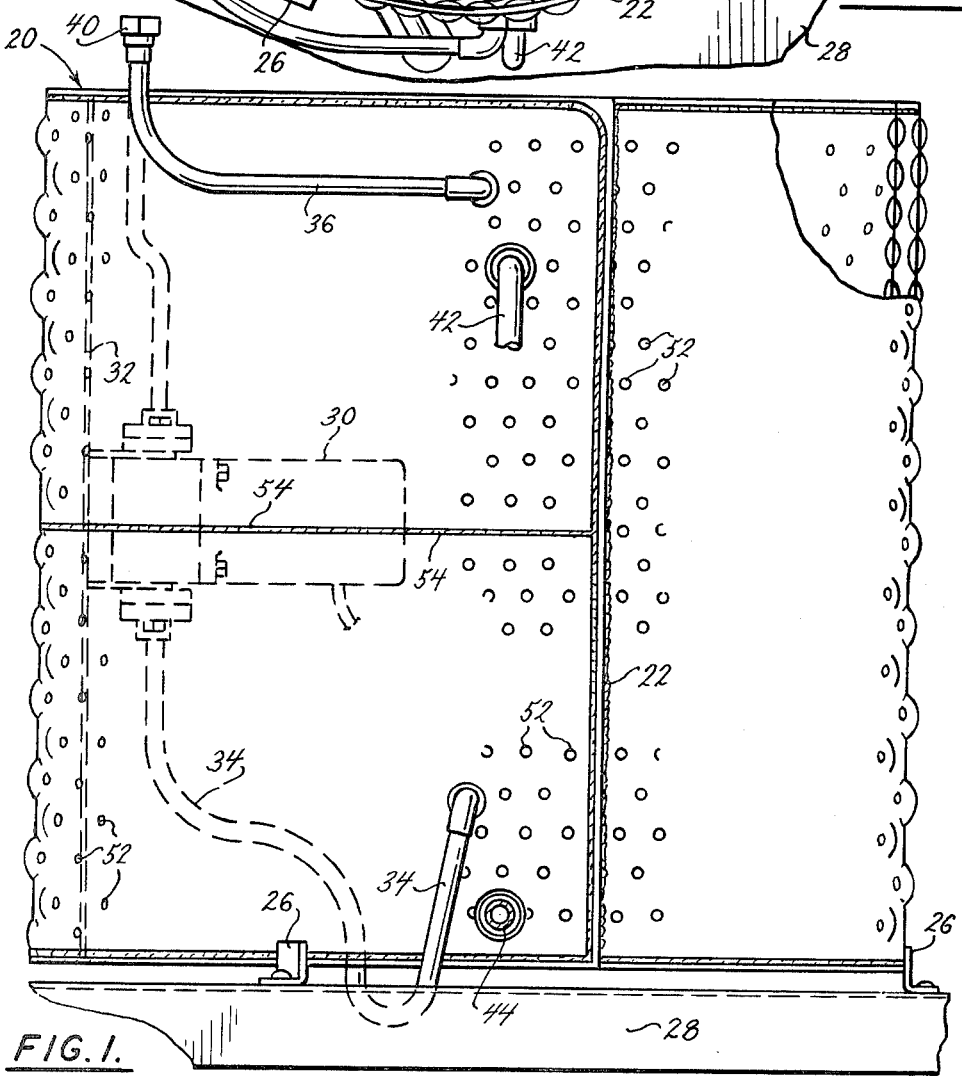
FIG. 1 is a front elevational view of the coiled heat exchanger showing the arrangement of the connections to both passageways.

As shown in FIGS. 1 and 2, the heat exchanger 20 may be coiled around itself and welded, such as at 22, 24 to make it self supporting, with support feet 26 mounting it from a base plate 28. A water pump 30 may be mounted from a bracket member 32 disposed in the interior of the coiled heat exchanger 20 and a water line 34 extends between the water pump 30 and the coiled heat exchanger 20. On the outlet side, a second water line 36 extends upwardly such that a pair of water connections, 38, 40 are oriented just above the top of the coiled heat exchanger 20. A refrigerant inlet 42 and and outlet 44 are also shown in FIG. 1, and will be more completely explained below.

Figure 3:
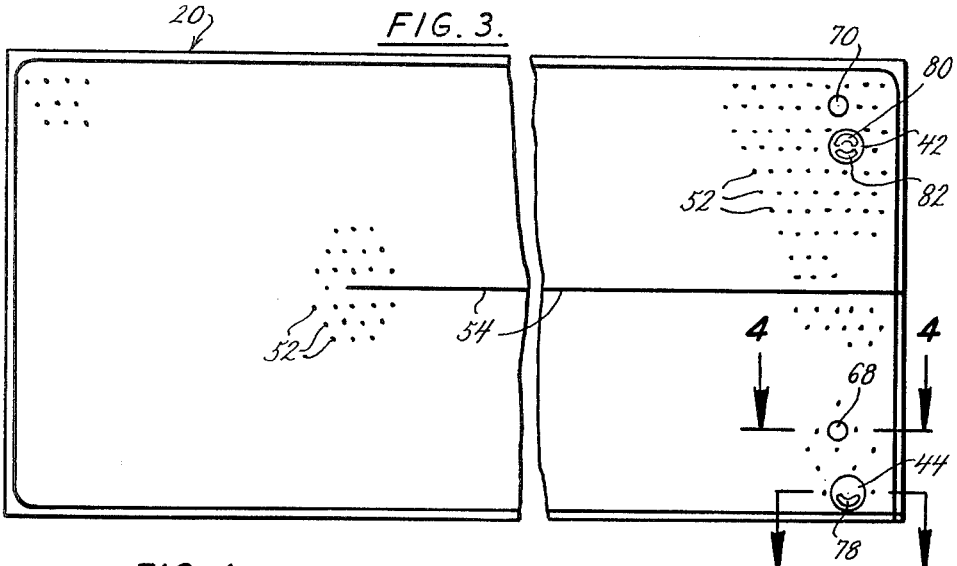
FIG. 3 is a front view of the sandwich type plate before it is coiled showing the spot welds and arrangement of the connections.
Figure 4:
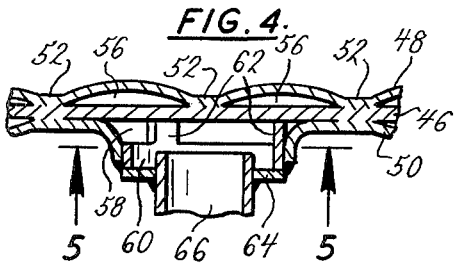
FIG. 4 is a cross sectional view taken along the plane of line 4—4 in FIG. 3 and showing the construction of a fluid type connection to the outside passageway.
Figure 5:
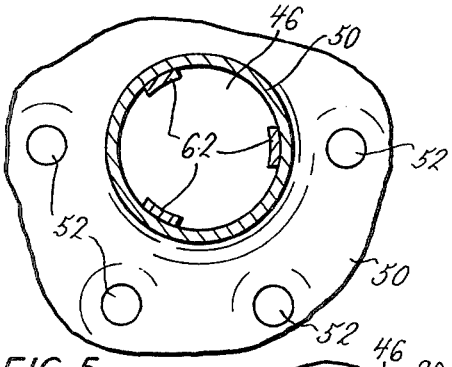
FIG. 5 is a cross sectional view taken along the plane of line 5—5 in FIG. 4 and detailing the construction of a fitting used in the fluid type connection of FIG. 4.

The coiled heat exchanger 20 is shown in greater detail in FIGS. 3 to 8, and generally comprises a central divider plate 46 sandwiched between a pair of somewhat thinner gauge expansion plates 48, 50, with an array of spot welds 52 dispursed throughout the heat exchanger 20 as is representationally shown in FIG. 3. A continuous seam weld 54 is horizontally oriented through a medial portion of the heat exchanger 20 and forms a baffle in the passageways 56, 58 between the two expansion plates 48, 50, and central divider plate 46. As best shown in FIGS. 4 and 5, a fluid type connection may be made to passageway 58 with a chair 60 having three legs 62 which fit down against the divider plate 46. A washer 64 mounts atop chair 60, and a tube 66 extends within the central opening of washer 64. These pieces are then welded in place and form a fluid tight connection between the tube 66 and passageway 58. This fluid tight connection to passageway 58, as shown in FIGS. 4 and 5, is the type of connection used to make the water inlet 68 and outlet 70 in heat exchanger 20.

Figure 6:
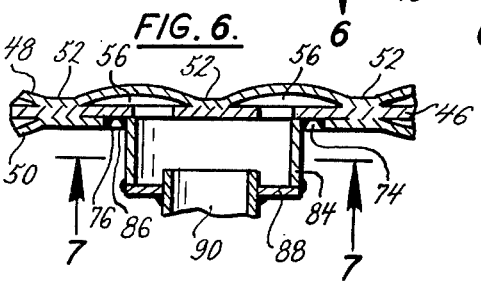
FIG. 6 is a cross sectional view taken along the plane of 6—6 in FIG. 3 and detailing the fluid type connection to the passageway opposite the divider plate.
Figure 7:
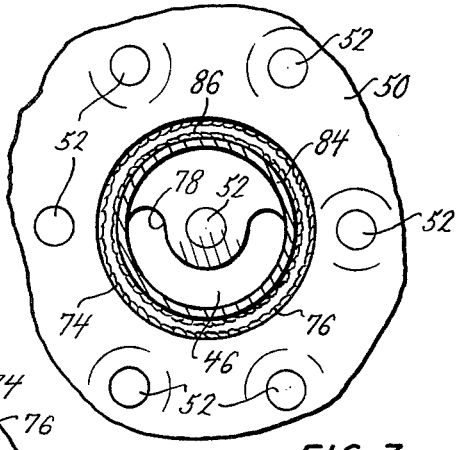
FIG. 7 is a partial cross sectional view taken along the plane of line 7—7 in FIG. 6 and showing the arcuate slot punched in the center divider plate.
Figure 8:
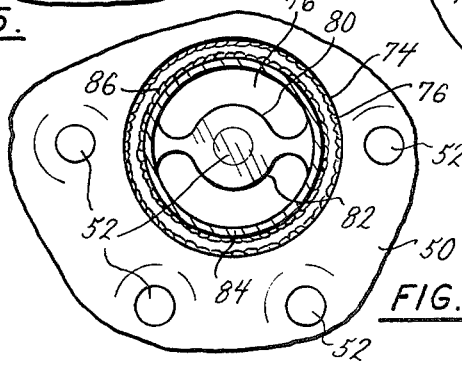
FIG. 8 shows an alternate embodiment utilizing two arcuate slots in the connection of FIG. 6.

A second type of fluid tight connection is shown in FIGS. 6 to 8, and is utilized to make the refrigerant inlet 42 and refrigerant outlet 44. As shown in FIG. 6, a hole 74 is cut in plate 50 and its edge welded to divider plate 46 by weld 76. For convenience, plate 50 is not spot welded to divider plate 46 at the point of connection, thereby making it easier to remove the cutout and punch the hole 74. An arcuate slot 78 is punched in divider plate 46, and fits within the envelope of hole 74. This arcuate slot 78 is best shown in FIG. 7 and surrounds in annular fashion a spot weld 52. Alternately, as shown in FIG. 8, a pair of arcuate slots 80, 82 may surround a spot weld 52 to provide a greater flow rate through the fluid connection. A tube member 84 is then placed over arcuate slot 78, or slots 80, 82, are welded in place as by weld 86. A washer 88 partially caps off tube member 84 and a connecting line 90 fits within the center hole of washer 88. These are also welded in position, as shown. The embodiment having two arcuate slots 80, 82, may be used for the refrigerant inlet connection 42 to provide a greater flow rate as the volume of refrigerant is greater before it traverses the heat exchanger 20 and liquifies. The embodiment having one arcuate slot 78 may then be used for the refrigerant outlets 44.

As is apparent from the foregoing, the fluid tight connections are made to the coiled heat exchanger 20 to provide access to both passageways 56, 58 from the outside of the coil. Furthermore, the arcuate slots 78 or 80, 82 do not materially detract from the structural integrity of the heat exchanger 20 as the spot weld 52 is positioned in its regular pattern despite the fluid connection.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What is claimed is:

1. A heat exchange unit comprising three plates, said plates comprising an adjacent outer plate, an inner plate, and an opposite outer plate, said plates being joined in sandwich fashion by a plurality of spaced spot welds extending through them, the outer plates being comprised of thinner gauge material and expanded away from said divider plate to increase the size of the passageway between each of said outer plates and the divider plate, and means to access the passageway between the divider plate and the opposite outer plate in fluid tight manner at one of said spot welds comprising means defining a hole in the adjacent outer plate, said hole being substantially centered over a spot weld, means defining a hole in said divider plate at least partially surrounding the spot weld, a connecting tube, said tube being positioned through said adjacent outer plate hole and against said divider plate and covering the hole therein, and means sealing the tube to the divider plate so that the tube is fluid coupled to the passageway between the opposite outer plate and the divider plate and fluid sealed from the passageway between the adjacent outer plate and the divider plate.

2. The device of claim 1 wherein said divider plate hole is wholly contained within the envelope of said hole in the adjacent outer plate.

3. The device of claim 1 wherein the divider plate hole comprises at least one arcuate slot in the divider plate at least partially surrounding the spot weld.

4. The device of claim 3 wherein said arcuate slots are wholly contained within the envelope of said hole in the adjacent outer plate.

5. The device of claim 1 wherein the hole in the adjacent outer plate is sealed by welding the edge thereof to the divider plate.

6. The device of claim 1 further comprising a second said fluid tight connection to said passageway between the opposite outer plate and said divider plate, one of said connections being positioned substantially near the top thereof and near one corner of the plates, and the other of said connections being positioned substantially near the bottom thereof and near the corner immediately below said first corner.

7. The device of claim 1 further comprising a second said fluid tight connection to said passageway between the opposite outer plate and said divider plate, and two fluid tight connections to the outer passageway, said heat exchange plates being coiled and all of said connections extending through the plates from the outside of the coiled heat exchanger.

8. The device of claim 7 wherein each passageway has one of its associated fluid tight connections substantially near the top thereof and near one corner of the plates and the other of its associated passageways substantially near the bottom thereof and near the corner immediately below said first corner.

9. The device of claim 1 wherein refrigerant flows through one of said passageways and water flows through the outer said passageway.

10. The device of claim 1 wherein at least one continuous weld joins said plates in a medial horizontal line to form a baffle in said passageways.

11. The device of claim 1 further comprising means to access the passageway between the adjacent outer plate and the divider plate comprising means defining a hole in the adjacent outer plate, a spacer member, said spacer member being positioned through said hole and against the divider plate, said spacer member having openings therein communicating with the passageway between the adjacent outer plate and the divider plate, a connecting tube, said tube being sealed to the spacer member, and means sealing the spacer member to the adjacent outer plate so that the tube is fluid coupled to said passageway between the adjacent outer plate and divider plate and fluid sealed from the passageway between the opposite outer plate and the divider plate.

12. The device of claim 11 further comprising a second said fluid tight connection to the passageway between the adjacent outer plate and the divider plate, and a second said fluid tight connection to the passageway between the opposite outer plate and the divider plate.

13. The device of claim 11 wherein the spacer member is generally cylindrical, and the openings are slots along the outer edge of the cylinder, said slots being thereby positioned adjacent the divider plate.

14. A coiled heat exchange unit comprising three plates, said plates comprising an adjacent outer plate, an inner divider plate, and an opposite outer plate, said plates being joined in sandwich fashion by a plurality of spaced spot welds extending through them, the outer plates being comprised of thinner gauge material and expanded away from said divider plate to increase the size of the passageway between each of said outer plates and the divider plate, and means to access the passageway between the divider plate and the opposite outer plate at each of two positions, one of said positions being a fluid inlet and the other being a fluid outlet, each said access means comprising means defining a hole in the adjacent outer plate, said hole being substantially centered over a spot weld, means defining a hole in said divider plate at least partially surrounding the spot weld, a connecting tube, said tube being positioned through said adjacent outer plate hole and against said divider plate, said tube covering the divider plate hole, and means sealing the tube to the divider plate so that the tube is fluid coupled to the passageway between the opposite outer plate and the divider plate and fluid sealed from the passageway between the adjacent outer plate and the divider plate.

15. The device of claim 14 further comprising means to access the passageway between the adjacent outer plate and the divider plate at each of two positions, one of said positions being a fluid inlet and the other of said positions being a fluid outlet, each said access means comprising means defining a hole in the adjacent outer plate, a spacer member, said spacer member being positioned through said hole and against the divider plate, said spacer member having openings therein communicating with the passageway between the adjacent outer plate and the divider plate, a connecting tube, said tube being sealed to the spacer member and means sealing the spacer member to the adjacent outer plate so that the tube is fluid coupled to said passageway between the adjacent outer plate and divider plate and fluid sealed from the passageway between the opposite outer plate and the divider plate.

* * * * *